US005845712A

United States Patent [19]

Griffith, Jr.

[11] Patent Number: 5,845,712

[45] Date of Patent: Dec. 8, 1998

[54] APPARATUS AND ASSOCIATED METHODS FOR GRAVEL PACKING A SUBTERRANEAN WELL

[75] Inventor: Claude F. Griffith, Jr., Houma, La.

[73] Assignee: Halliburton Energy Services, Inc., Dallas, Tex.

[21] Appl. No.: 763,646

[22] Filed: Dec. 11, 1996

[51] Int. Cl.[6] ..... E21B 43/04

[52] U.S. Cl. ..... 166/278; 166/51

[58] Field of Search ..... 166/51, 278, 114, 166/205, 378

[56] References Cited

U.S. PATENT DOCUMENTS

| | | | |
|---|---|---|---|
| 4,541,486 | 9/1985 | Wetzel et al. | 166/278 X |
| 4,944,348 | 7/1990 | Whiteley et al. | 166/278 |
| 5,329,998 | 7/1994 | King et al. | 166/278 X |

OTHER PUBLICATIONS

Halliburton Company presentation; "Halliburton One Trip Perf/Pack Perforating"; undated.

*Primary Examiner*—Frank S. Tsay
*Attorney, Agent, or Firm*—Paul I. Herman; J. Richard Konneker

[57] ABSTRACT

Apparatus and associated methods for performing operations within a subterranean well overcome many disadvantages associated with perforating and fracturing and/or gravel packing in a single trip of a work string into the well. In a preferred embodiment, a method of producing fluids from a formation intersected by the well includes the step of setting a packer having a relatively large seal bore formed therethrough in the well before running the work string into the well. After the formation is perforated, the work string is displaced to position a seal assembly on the work string in the seal bore, thereby displacing the perforating guns through the packer, positioning a screen opposite the perforated formation, and enabling performance of gravel packing operations thereafter.

40 Claims, 5 Drawing Sheets

APPARATUS AND ASSOCIATED METHODS FOR GRAVEL PACKING A SUBTERRANEAN WELL

BACKGROUND OF THE INVENTION

The present invention relates generally to operations performed in connection with subterranean wells and, in a preferred embodiment thereof, more particularly provides a gravel packing apparatus and associated methods of gravel packing a subterranean well.

It has for some time been considered advantageous to both perforate and perform other operations, such as fracturing and/or gravel packing operations, on a formation intersected by a subterranean well in a single trip of a work string into the well. Some of the advantages associated with a single trip of the work string include decreased rig time, increased safety due to improved well control, increased safety associated with less equipment handling on the rig, elimination of the need to kill the well between operations, and, generally, less cost associated with decreased trips into the well.

Unfortunately, previous attempts to configure a work string for such single trip operations have met with only limited success. A major cause of problems in single trip operations is the shock produced by perforating guns when they are detonated to perforate the formation. This shock frequently causes destruction of other equipment in the work string, prematurely sets one or more packers on the work string, damages screens, etc.

One solution to this problem has been proposed, in which a shock absorber is installed between the perforating guns and the other equipment on the work string. However, the shock absorber introduces its own problems, such as, unreliable operation, inaccurate positioning of the perforating guns, ineffectiveness, etc. Thus, the problem has not been solved by the use of shock absorbers.

Another solution that has been proposed is to separately convey the perforating guns and a packer into the well. The packer is set in the well with the perforating guns suspended from the packer. The guns are then detonated and a work string is lowered into the well to latch onto the packer, unset the packer, lower the guns and packer further into the well, and then reset the packer below the perforated formation. Gravel packing, fracturing, and/or other operations may then be performed above the reset packer.

Of course, since the perforating guns are separately conveyed into the well, this solution does not have all the benefits associated with conveying the guns into the well with the remainder of the work string. Additionally, this solution requires the packer to be set, unset, and then reset, increasing dramatically the chances that the packer will not properly seal when it is reset in the well.

From the foregoing, it can be seen that it would be quite desirable to provide apparatus and associated methods of performing perforating, fracturing, and/or gravel packing operations which do not require the use of shock absorbers, which do not require perforating guns to be separately conveyed into the well, and which do not require a packer to be set multiple times within the well, but which permits the operations to be performed in a single trip of a work string into the well. It is accordingly an object of the present invention to provide such apparatus and associated methods of completing a subterranean well.

SUMMARY OF THE INVENTION

In carrying out the principles of the present invention, in accordance with an embodiment thereof, a work string is provided which is a combination of mechanically- and hydraulically-set packers, screens, and seal assemblies, utilization of which does not have the disadvantages associated with multiple trips into a subterranean well, or with perforating while the work string is positioned within the well, but which enables convenient gravel packing and/or fracturing operations on the same trip into the well as for perforating operations. In another disclosed embodiment, completion fluids may be conveniently recovered before the well is placed in production. Associated methods are also disclosed.

In broad terms, apparatus for producing fluids from a formation intersected by a subterranean well is provided. The apparatus includes first and second packers, a generally tubular screen, and a seal assembly. These are operatively interconnected to form a work string. The apparatus may also include a third packer, a flapper valve, a packer service tool, and a perforating gun.

A method of producing fluid from a formation intersected by a subterranean wellbore is also provided. The method includes the step of operatively positioning a first packer within the wellbore, the first packer having a generally axially extending seal bore formed therethrough. The first packer is positioned relative to the formation, such that the formation is axially between the first packer and the earth's surface.

A work string is then suspended within the wellbore. The work string includes a generally axially extending seal assembly, a generally tubular screen assembly, and a second packer. The screen assembly is preferably interconnected axially between the seal assembly and the second packer.

The formation is perforated next. In the disclosed embodiment, the work string includes a perforating gun suspended below the seal assembly for perforating the formation.

The seal assembly is then sealingly engaged with the seal bore by inserting the seal assembly axially into the first packer. In the disclosed embodiment, the perforating gun passes through the first packer when the work string is lowered to insert the seal assembly into the seal bore.

The second packer is then set. In the disclosed embodiment, the second packer is of the type used in gravel packing operations, and is set by dropping a ball through the work string and applying pressure to the work string.

Another method of producing fluids from a formation intersected by a subterranean well is provided as well. The method includes the steps of providing first, second, and third packers, the first packer being mechanically settable, the second packer being hydraulically settable, and the third packer having a seal bore formed axially therethrough; providing a generally tubular screen and a generally axially extending seal assembly, the seal assembly being capable of axial insertion into the seal bore and sealing engagement therewith; assembling a work string by interconnecting the first and second packers, the screen, and the seal assembly; setting the third packer within the well; and positioning the work string at a first position within the well so that the seal assembly sealingly engages the seal bore.

Yet another method of producing fluids from a formation intersected by a subterranean well is provided. The method includes the steps of providing first, second, and third packers, the third packer having a seal bore formed axially therethrough; providing a generally tubular screen and a generally axially extending seal assembly, the seal assembly being capable of axial insertion into the seal bore and sealing engagement therewith; providing a flapper valve; assembling a work string by interconnecting the first and second packers, the screen, the seal assembly, and the flapper valve; setting the third packer within the well; and positioning the work string at a first position within the well so that the seal assembly sealingly engages the seal bore.

The use of the disclosed apparatus and methods enables convenient one-trip perforating and gravel packing and/or fracturing operations to be performed in subterranean wells. Additionally, recovery of completion fluids is enhanced. These and other objects and advantages of the present invention will become apparent upon consideration of the following description and associated drawings.

DETAILED DESCRIPTION

Figure 1:
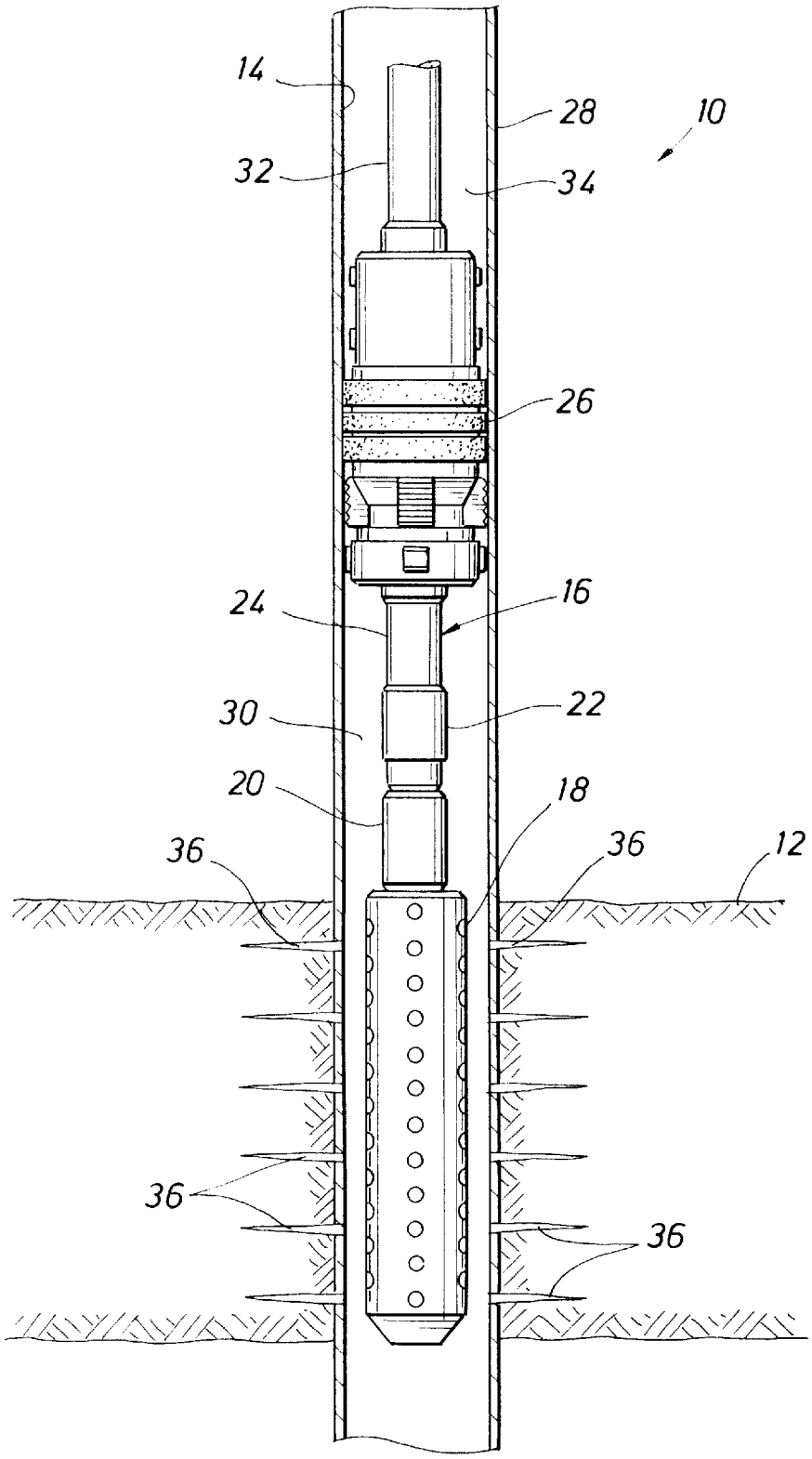
FIG. 1 (PRIOR ART)
FIG. 1 (PRIOR ART) is a schematic cross-sectional view of a method of gravel packing a subterranean well.

Illustrated in FIG. 1 (PRIOR ART) is a prior art method 10 of perforating and gravel packing a formation 12 intersected by a subterranean wellbore 14. As shown in FIG. 1, a first work string 16 is lowered and positioned within the wellbore 14, so that a perforating gun 18 of the work string is opposite the formation 12.

The first work string 16 may also include a firing head 20 for detonating explosive charges in the perforating gun 18, a tubing release 22 for releasing the perforating gun from the work string after the formation 12 has been perforated, one or more spacer subs 24, and a packer 26 for anchoring the perforating gun in its proper position opposite the formation and providing a fluid seal between the work string and casing 28 lining the wellbore 14. Of course, the work string 16 may include various other components in addition to, or in substitution for, those shown in FIG. 1. For example, one or more of the spacer subs 24 may be perforated or ported to permit fluid communication between an annulus 30 below the packer 26 and the interior of a tubing string 32 extending to the earth's surface. In this manner, an annulus 34 above the packer 26 may be filled with appropriately weighted fluid to permit control of the well, while the tubing string 32 may be filled with a lighter fluid, only partially filled, etc., to produce an underbalanced condition at the formation 12 when it is perforated.

In addition, instead of being conveyed into the wellbore 14 suspended from the tubing string 32, the packer 26, perforating gun 18, etc. may be conveyed into the wellbore suspended from wireline. In that case, the packer 26 may be of the type which is set by ignition of a propellant charge. However, where the wellbore 14 is highly deviated or horizontal, it is impractical to use a wireline to convey the work string 16 into the wellbore 14.

As shown in FIG. 1, the gun 18 has been detonated, forming perforations 36 through the casing 28 and into the formation 12. After the formation 12 is perforated, the gun 18 may be released from the work string 16 by activating the tubing release 22. Additionally, stimulation fluids, such as acid, may be pumped through the tubing string 32 from the earth's surface and into the formation 12 through the perforations 36.

Where fracturing and/or gravel packing operations are to be performed, the packer 26 is unset, lowered in the wellbore 14 until it is below the perforations 36, and then is reset in the casing 28. In this manner, the packer 26 becomes, in effect, a sump packer during the fracturing and/or gravel packing operations. Note that it is often difficult to obtain a satisfactory seal against the casing 28 when the packer 26 is reset, due to abrasion of the packer rubbers, debris in the annulus 30 from the perforating operation (particularly in horizontal, or nearly horizontal, wells where the perforating debris tends to collect on the low side of the wellbore), malfunctioning of the packer, etc.

Figure 2:
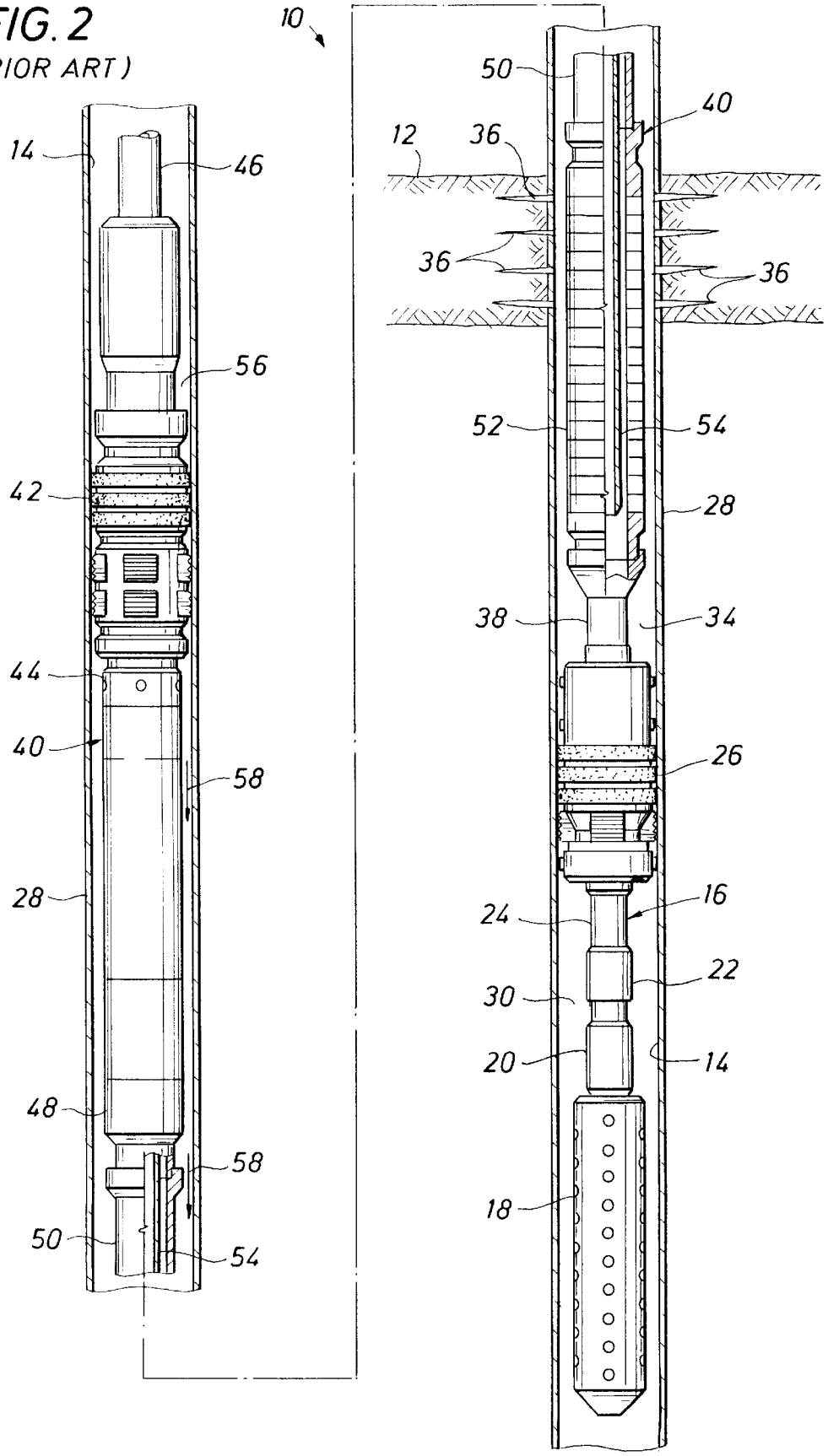
FIG. 2 (PRIOR ART)
FIG. 2 (PRIOR ART) is a schematic cross-sectional view of the method of FIG. 1, wherein a formation of the well has been perforated and a screen assembly has been positioned opposite the formation.

FIG. 2 (PRIOR ART) shows the packer 26 reset in the casing 28 below the formation 12 and perforations 36. For this purpose, a packer setting tool 38 has been latched into the packer 26. The setting tool 38 may be conveyed into the wellbore 14 after the tubing string 32 is removed from the wellbore.

The setting tool 38 is connected on the bottom of a second work string 40, which includes equipment commonly used in fracturing and/or gravel packing operations. FIG. 2 shows gravel packing equipment, such as, a packer 42 designed specifically for gravel packing, a crossover 44 for providing fluid communication between the interior of a tubing string 46 extending to the earth's surface and the annulus 34, a shear sub 48 for permitting release and retrieval of the packer 42, crossover 44, and tubing string 46 apart from the remainder of the work string 40, one or more spacer subs 50, and one or more screens 52. Generally, a wash pipe 54 is suspended within the spacer subs 50 and screens 52, and the crossover 44 may selectively permit fluid communication from the interior of the wash pipe and an annulus 56 above the packer 42 extending to the earth's surface.

Fracturing of the formation 12 may be accomplished by pumping proppant-laden fluid (indicated by arrows 58) from the earth's surface, through the tubing string 46, outward through the crossover 44 into the annulus 34, through the perforations 36, and into cracks formed thereby in the formation 12. In cases where it is desired to circulate the fracturing fluid (minus the proppant) back to the earth's surface, the fluid is permitted to flow inward through the screens 52, into the wash pipe 45, upward through the crossover 44, through the packer 42, and into the annulus 56.

It will be readily apparent to one of ordinary skill in the art that, if the sump packer 26 does not properly seal against the casing 28, fracturing fluid will be permitted to flow past the sump packer, thereby wasting that fluid and possibly preventing desired fracturing pressure from being built up in the annulus 34 without significant additional pumping effort. Of course, an operator at the earth's surface will not know that the sump packer 26 is not properly sealing until the work string 40 has been run into the wellbore 14 to latch the setting tool 38 onto the packer and reset it. Thus, if the sump packer 26 does not properly seal, a trip into the wellbore 14 of the work string 40 may additionally be wasted, and the entire first and second work strings 40, 16 may have to be retrieved from the wellbore in order to replace or recondition the sump packer 26.

If it is desired to perform gravel packing operations, gravel-laden fluid (also indicated by arrows 58) may be pumped from the earth's surface through the tubing string 46, outward through the crossover 44, into the annulus 34, and into the perforations 36. Generally, it is desired for the gravel to accumulate in the annulus 34 between the screen 52 and the casing 28. The gravel packing fluid (minus the gravel) may be circulated back to the earth's surface by flowing it inward through the screen 52, through the wash-pipe 54, through the crossover 44 and packer 42, and upward through the annulus 56. Again, if the sump packer 26 does not properly seal against the casing 28, the gravel packing fluid, including the gravel, may flow past the packer 26 and be wasted. Additionally, it may not be possible to properly perform the gravel packing operation, since it may be desired to build up specific fluid pressure within the annulus 34, for example, to inject fluid into the formation 12 during, or in association with, the gravel packing operation.

Attempts have been made in the past to, in effect, run the first and second work strings 16, 40 combined initially (such that the perforating operation is performed with the second work string 40 attached to the first work string 16). However, the shock of detonating the perforating gun 18 typically damages the screens 52, spacer subs 50, shear sub 48, and/or causes the upper packer 42 to set prematurely. This, of course, necessitates expensive time-consuming remedial operations to repair the damage. Thus, such operations are generally considered to be unreliable.

Note that, at times, it may be necessary to utilize expensive completion fluids, such as Zinc Bromide (ZnBr), in these operations. Typically, no provision is made for retrieving these completion fluids after the fracturing and/or gravel packing operations are completed and the well is placed in production. Additionally, after the formation 12 has been perforated, the completion fluid may be lost by permitting it to flow through the perforations 36 and outward into the formation.

Figure 3:
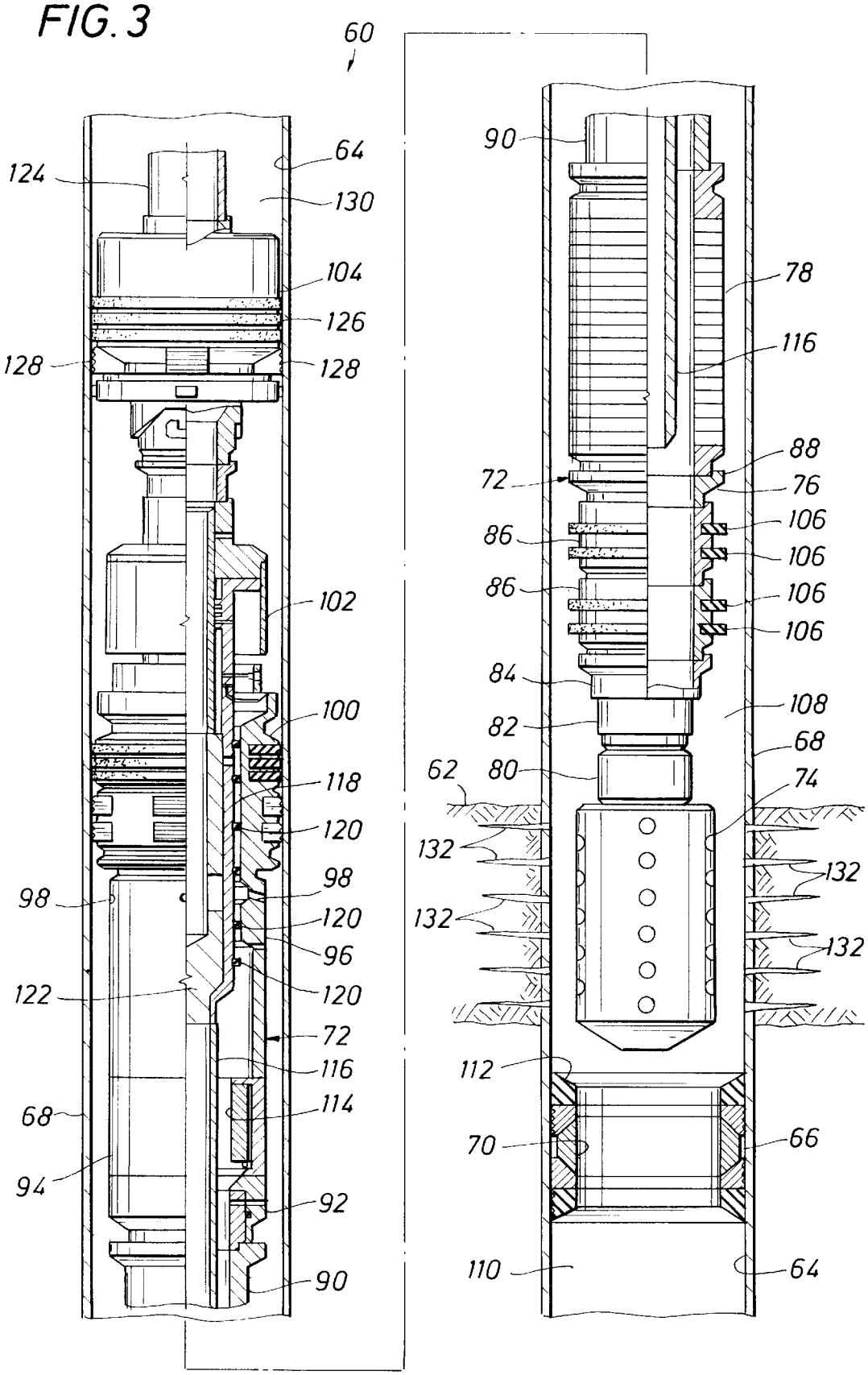
FIG. 3 is a schematic cross-sectional view of a work string and associated method for gravel packing a subterranean well, the work string and method embodying principles of the present invention.
Figure 4:
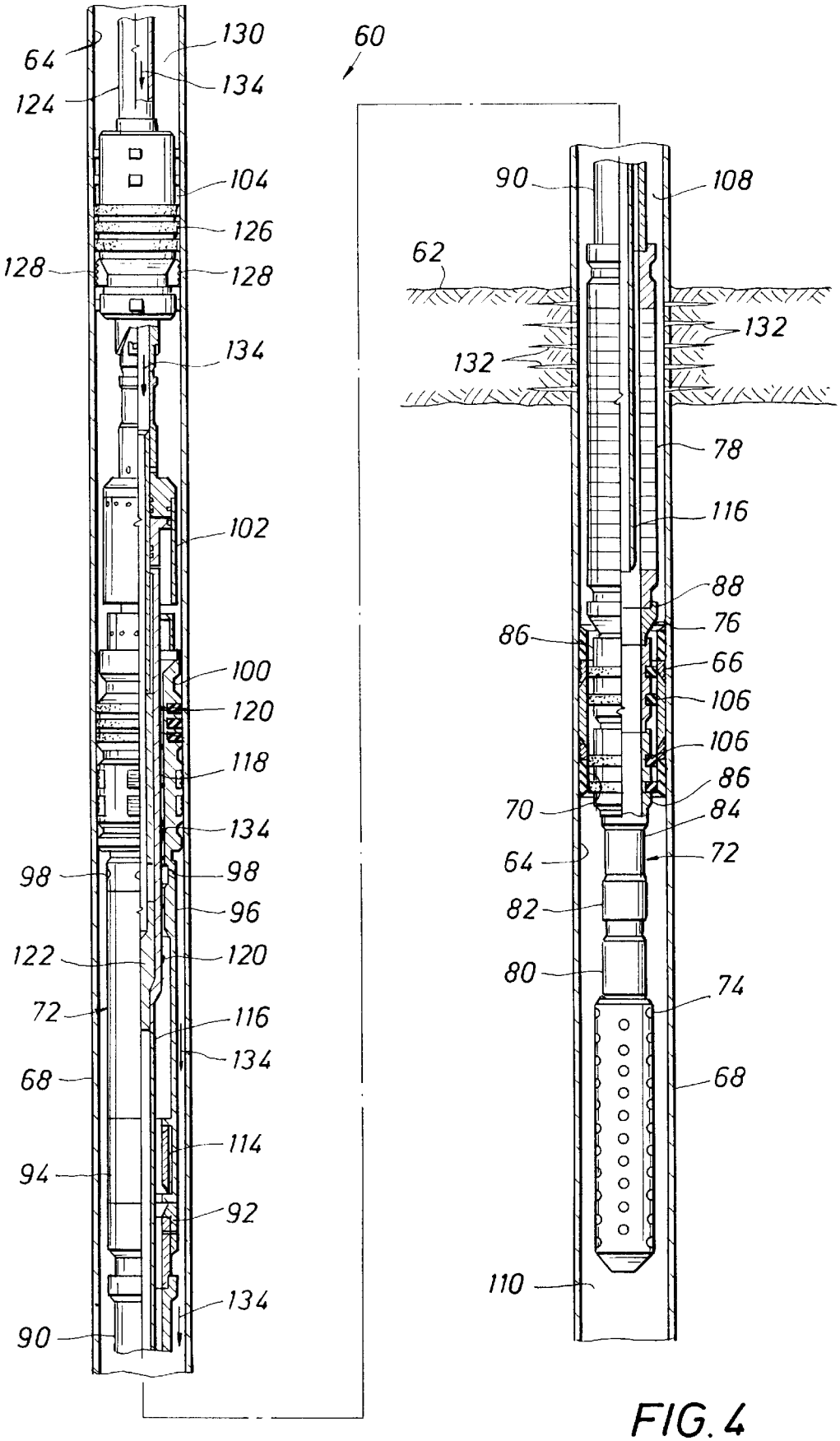
FIG. 4 is a schematic cross-sectional view of the work string and method of FIG. 3, wherein a formation of the well has been perforated and a screen assembly has been positioned opposite the formation.
Figure 5:
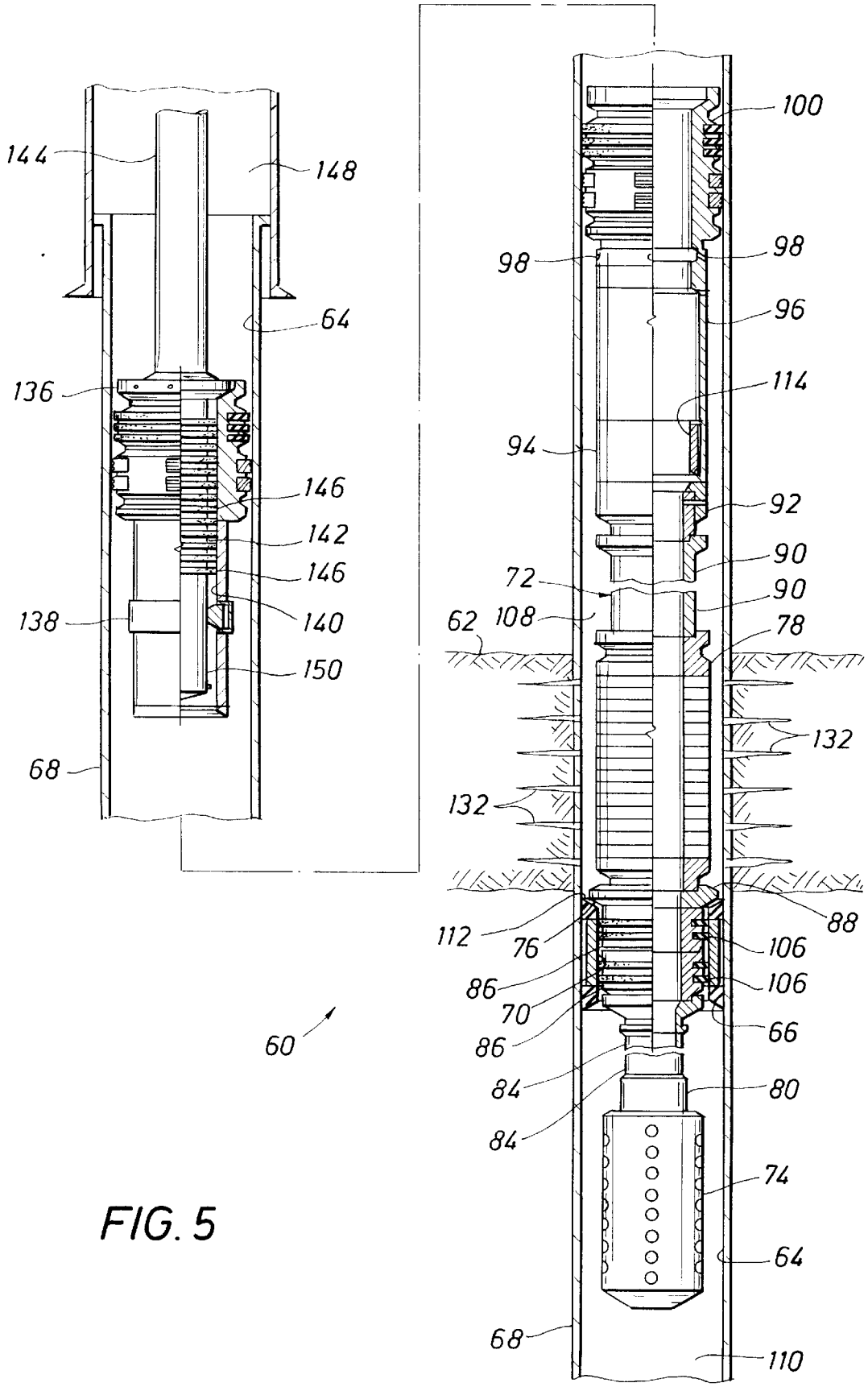
FIG. 5 is a schematic cross-sectional view of the work string and method of FIGS. 3 & 4, wherein an upper packer has been set in the well, providing enhanced fluid circulation features.

Turning now to FIGS. 3–5, a method 60 for producing fluids from a formation 62 intersected by a subterranean wellbore 64 is representatively illustrated, the method embodying principles of the present invention. In the following detailed descriptions of the embodiments of the present invention representatively illustrated in the accompanying figures, directional terms, such as "upper", "lower", "upward", "downward", etc., are used in relation to the illustrated embodiments as they are depicted in the accompanying figures, the upward direction being toward the top of the corresponding figure, and the downward direction being toward the bottom of the corresponding figure. It is to be understood that the embodiments may be utilized in vertical, horizontal, inverted, or inclined orientations without deviating from the principles of the present invention. It is also to be understood that the embodiments are schematically represented in the accompanying figures.

In the method 60, a sump packer 66 is run into the wellbore 64 on wireline (not shown), correlated, and set in casing 68 lining the wellbore. The sump packer 66 seals against the casing 64 and is anchored thereto when it is set. It includes a polished seal bore 70 which extends axially therethrough.

For purposes that will become apparent upon consideration of the further description of the method 60 hereinbelow, it is desired for the seal bore 70 to be relatively large. Applicant prefers use of a "BBP" sump packer, manufactured and available from Halliburton Company of Duncan, Okla., for the packer 66 in the method 60, since it includes the desired large seal bore 70, reliably seals against the casing 68, rigidly anchors to the casing, and is generally reliable, convenient, and economical in its use and operation. However, it is to be understood that other sump packers may be utilized in the method 60 without departing from the principles of the present invention.

The sump packer 66 is set in the casing 68 below the formation 62, so that the formation is between the sump packer and the earth's surface. For purposes that will become apparent upon consideration of the further description of the method 60 hereinbelow, when the sump packer 66 is correlated and set, it is thereby positioned a desired preselected axial distance from the interval of the formation 62 to be perforated.

After the sump packer 66 has been set in the wellbore 64, a work string 72 is made up (the various components thereof being operatively interconnected) at the earth's surface and lowered into the wellbore. For purposes that will become apparent upon consideration of the further description of the method 60 hereinbelow, when the work string 72 is made up, a perforating gun 74 is positioned a preselected axial distance from an external no-go shoulder 76, and the no-go shoulder is positioned a preselected axial distance from a screen 78. As will be more fully described hereinbelow, these preselected distances are utilized to ensure that the various components of the work string 72 are properly positioned during the various operations performed with the work string in the wellbore 64.

The work string 72 preferably includes the perforating gun 74 (or multiples thereof), which includes explosive charges for perforating the casing 68 and forming flow passages into the formation 62, a firing head 80 for detonating the perforating gun explosive charges, a tubing release 82 for permitting separation of the perforating gun and firing head from the remainder of the work string, one or more safety spacers 84, one or more sets of seal assemblies 86, a no-go 88, which includes the no-go shoulder 76, the screen 78 (or multiples thereof), one or more spacer subs 90, a shear sub 92, which permits separation of the portion of the work string below the shear sub from the remainder of the work string, a flapper valve 94, which permits fluid flow axially upward therethrough, but which is capable of preventing flow axially downward therethrough, an outer gravel pack assembly 96, which includes ports 98 formed radially therethrough, a hydraulically settable gravel pack packer 100, a packer service tool 102, and a mechanically settable packer 104. It is to be understood that the work string 72 may include various other components in addition to, or in substitution for, those components shown in the accompanying drawings, without departing from the principles of the present invention. Additionally, the work string 72 may not include certain of the components shown. For example, if it is desired to convey the perforating gun 74 into the wellbore 64 on wireline, instead of suspended from the work string 72, that may be easily accomplished, although such would not be preferred, since a wireline conveyed perforating gun would generally have to be relatively small in diameter to pass through the interior of the work string.

Where the perforating gun 74 is conveyed into the wellbore 64 interconnected with, and suspended from, the work string 72 in the method 60 as representatively illustrated in FIGS. 3–5, it should have an outer diameter after detonation that is smaller than the seal bore 70 of the sump packer 66. As will be more fully described hereinbelow, it is desired for the perforating gun 74, firing head 80, tubing release 82, and safety spacer 84 to be displaced axially through the seal bore 70 after the perforating gun has been detonated.

The firing head 80 is preferably of the type well known to those of ordinary skill in the art, wherein pressure is applied thereto to initiate ignition of a delay fuse, the firing head detonating the perforating gun 74 upon completion of the delay time corresponding to the length of the delay fuse. In this way, pressure may be applied to the firing head 80, and then bled off before the perforating gun 74 detonates, permitting the formation 62 to be perforated in an underbalanced or balanced condition. However, it is to be understood that other firing heads, such as the type in which a bar is dropped from the earth's surface to detonate the perforating gun 74, etc., may be utilized in the method 60 without departing from the principles of the present invention.

The seal assemblies 86 are generally tubular and have a series of axially spaced apart circumferential seals 106 disposed externally thereon. The seal assemblies 86 are configured for axial insertion into the sump packer 66 and for sealing engagement of the seals 106 with the seal bore 70. In this way, an annulus 108 above the sump packer 66 may be selectively placed in fluid isolation from a portion 110 of the well below the sump packer.

The no-go sub 88 is interconnected axially between the screen 78 and the seal assemblies 86. The no-go shoulder 76 formed thereon is configured for axial engagement with a complementarily shaped upper shoulder 112 formed on the sump packer 66. Thus, when the work string 72 is displaced axially downward to displace the perforating gun 74 through the sump packer 66 and sealingly engage the seal assemblies 86 with the seal bore 70, the no-go sub 88 provides a positive positioning device, ensuring that the work string is properly positioned relative to the formation 62 for subsequent operations within the wellbore 64.

The screen 78 is of the type commonly utilized in gravel packing and/or fracturing operations. It is generally tubular and is interconnected axially between the no-go sub 88 and the spacer sub 90. Applicant prefers that the screen 78 and spacer sub 90 be constructed utilizing P-grade tubular material, specifically, P-110 material, for its enhanced ability to withstand the shock produced by detonation of the perforating gun 74.

The flapper valve 94 is preferably of the type having a hinged flapper 114 disposed therein. The flapper 114 enables the flapper valve 94 to operate somewhat as a check valve, permitting fluid flow therethrough in only one axial direction. As shown in FIG. 3, the flapper 114 is held open by a generally tubular washpipe 116 suspended from the packer service tool 102 and extending axially into the screen 78. For purposes that will become apparent upon consideration of the further description hereinbelow, the flapper 114 may, in one embodiment of the method 60, be constructed of a frangible material, such as ceramic, so that when the flapper valve 94 is closed, a sufficient pressure differential applied from above the flapper will cause it to break and, thus, effectively open the flapper valve when desired. A suitable flapper valve is manufactured and available from Halliburton Company of Duncan, Okla. Note that the flapper valve 94 is not needed if it is not desired to prevent fluid loss into the formation 62 in the method 60.

The gravel pack packer 100 is preferably of the type specifically designed for gravel packing operations, with fluid flow passages and sealing surfaces formed therein for directing fluid flow therethrough. Applicant prefers use of a "VTL" gravel pack packer (a.k.a. VERSA-TRIEVE®) manufactured by, and available from, Halliburton Company of Duncan, Okla. in the method 60 for its demonstrated reliability, hydraulic setting capability, ruggedness, and convenience and economy of use and operation. The VTL gravel pack packer is not affected by shock, such as that produced by detonation of the perforating gun 74, making its use desirable in the method 60.

The packer service tool 102 is operatively engaged with the gravel pack packer 100 and has a portion 118 thereof extending axially through the gravel pack packer. Circumferential seals 120 axially spaced apart and externally disposed thereon selectively sealingly engage various seal surfaces formed internally on the gravel pack packer 100 and outer gravel pack assembly 96 to alternately permit and prevent fluid flow thereacross or therethrough. Such combinations of packer service tool 102, gravel pack packer 100, and outer gravel pack assembly 96 are well known to those of ordinary skill in the art. Applicant, however, prefers use of an "MPT" packer service tool (a.k.a. "multiposition service tool") for the packer service tool 102 in the method 60, due to its demonstrated reliability and convenience and economy of use and operation. Specifically, the MPT service tool, when used in combination with the VTL gravel pack packer, enhances the capability of the gravel pack packer to withstand the shock produced by detonation of the perforating gun 74 without prematurely setting. The MPT service tool is manufactured by and is available from Halliburton Company of Duncan, Okla.

Note that, as representatively and schematically depicted in FIG. 3, the portion 118 of the service tool 102 extending axially through the gravel pack packer 100 includes an axially plugged portion 122. It is to be understood that when the preferred MPT service tool is used for the service tool 102 in the method 60, the portion 118 may not include the plugged portion 122 until one or more balls have been installed therein to block fluid flow axially through the portion 122 and divert the fluid flow outward through the ports 98.

The upper packer 104 is preferably of the type which may be mechanically-set by manipulation of a tubing string 124 attached thereto and extending to the earth's surface. Typically, such a mechanically-set packer is set by rotation of the tubing string 124 to produce a predetermined rotation of a mandrel within the packer, and then the tubing string is lowered to compress packer rubbers 126 and radially outwardly extend slips 128, so that the packer both sealingly and grippingly engages the casing 68. Applicant prefers use of a "Champ IV" packer manufactured by and available from Halliburton Company of Duncan, Okla. for the packer 104 in the method 60.

The work string 72 is conveyed into the wellbore 64 suspended from the tubing string 124. The perforating gun 74 is then positioned opposite the formation 62 (or a particular desired interval of the formation). For accurate positioning of the perforating gun 74 relative to the formation 62, the work string 72 may be lowered until the no-go 88 engages the sump packer 66, and then raised appropriately. It will be recalled that the axial distance between the sump packer 66 and the formation 62, and the axial distance between the no-go shoulder 76 and the perforating gun 74 were determined previously in the method 60. Alternatively, or in addition, positioning of the perforating gun 74 relative to the formation 62 may be performed by correlation methods well known to those of ordinary skill in the art.

The packer 104 is then set. For example, the tubing string 124 is rotated clockwise at the earth's surface to produce a one-quarter turn rotation at the packer 104, and then the tubing string is lowered to set the packer. Fluid pressure may then be applied to an annulus 130 radially between the tubing string 124 and the casing 68 extending to the earth's surface, in order to test the packer 104. Approximately 1500 psi fluid pressure applied to the annulus 130 at the earth's surface may be utilized for this purpose.

To detonate the perforating gun 74, pressure may be applied to the interior of the tubing string 124 at the earth's surface to cause ignition of the delay fuse in the firing head 80, or, if another type of firing head is utilized, that firing head may be activated at this point by, for example, dropping a bar through the tubing string to impact the firing head. Recall that the plugged portion 122 is not present at this point in the method 60 if the preferred MPT service tool is used for the service tool 102. If pressure has been applied to the tubing string 124, after the delay fuse has been ignited that pressure is bled off at the earth's surface in order to produce a desired underbalanced or balanced condition at the formation 62 prior to detonation of the perforating gun 74.

The perforating gun 74 detonates, thereby forming perforations 132 through the casing 68 and into the formation 62. Fluid communication is, thus, established between the formation 62 and the annulus 108.

The preferred Champ IV packer used for the packer 104 includes a bypass port (not shown), which may be opened by raising the tubing string 124. In the preferred embodiment of the method 60, the tubing string 124 is raised to open the bypass port, thereby permitting fluid communication between the annulus 130 and the interior of the tubing string 124, after the perforating gun 74 has been detonated. It is to be understood that other methods of establishing such fluid communication may be utilized without departing from the principles of the present invention.

Fluid is then circulated from the earth's surface downward through the annulus 130, through the bypass port in the packer 104, into the annulus 108, inward through the screen 78, into and upward through the washpipe 116, through the service tool 102, axially through the packer 104, and to the earth's surface through the interior of the tubing string 124. The circulated fluid is preferably weighted to "kill" the well, that is, produce a hydrostatic pressure at the formation 62 which is greater than fluid pressure within the formation. In this way, the only fluid within the wellbore 64 which may contain gas bubbles would be from the lower end of the washpipe 116 downward. Applicant prefers that a time period of approximately one hour elapse after the well is killed before subsequent operations are performed therein.

After the well has been killed, the packer 104 is unset by, for example, applying a predetermined upwardly directed force thereto by raising the tubing string 124 at the earth's surface. Applicant prefers that the work string 72 then be raised sufficiently to displace the perforating gun 74 away from the perforations 132 and thereby permit any debris from the perforating operation to fall away from between the gun and the casing 68. However, this step is not necessary in the method 60.

The work string 72 is then lowered, displacing the seal assemblies 86 axially downward into sealing engagement with the sump packer 66. The work string 72 is displaced axially downward until the no-go surface 76 contacts the upper surface 112 of the sump packer 66, the perforating gun 74 passing axially through the sump packer. At this point, the screen 78 is preferably positioned opposite the perforated formation 62. Recall that the predetermined axial distance from the no-go surface 76 to the screen 78 was set previously for this purpose.

If the MPT service tool and VTL gravel pack packer are used for the service tool 102 and gravel pack packer 100, respectively, in the method 60, a first ball (not shown) is transported through the tubing string 124 (e.g., by dropping it from the earth's surface) to the portion 118 of the service tool. The first ball forms a check valve by engagement with a tapered seat (not shown) within the portion 118. A second ball (not shown) is then transported through the tubing string 124 (e.g., by dropping it from the earth's surface) to the portion 118. The second ball sealingly engages an upper isolation sleeve expandable ball seat (not shown) in the portion 118. Fluid pressure (preferably approximately 900 psi) is then applied to the interior of the tubing string 124 at the earth's surface to open the isolation sleeve. The fluid pressure on the interior of the tubing string 124 is then increased to approximately 3900 psi to set the gravel pack packer 100, and to displace and then expand the ball seat and permit the second ball to drop onto a tapered seat, thereby forming the plugged portion 122. This fluid pressure on the interior of the tubing string 124 is preferably maintained for purposes that will be described hereinbelow.

After the gravel pack packer 100 has been set (see FIG. 4), fluid pressure is applied to the annulus 130 at the earth's surface to test the sealing engagement of the packer with the casing 68. This fluid pressure on the annulus 130 is then released.

An upwardly directed force is then applied to the tubing string 124 at the earth's surface to test the gripping engagement of the gravel pack packer 100 with the casing 68. The upwardly directed force is then increased to shear shear screws (not shown), which act to prevent relative axial displacement between the service tool 102 and the gravel pack packer 100, to thereby permit axial displacement between the service tool and the gravel pack packer. The fluid pressure on the interior of the tubing string 124 assists in shearing the shear screws, since the service tool 102 acts as a piston within the internal seal surfaces of the gravel pack packer 100. This assistance from the fluid pressure on the interior of the tubing string 124 is especially helpful in highly deviated or horizontal wells.

After the shear screws have been sheared, the fluid pressure on the interior of the tubing string 124 is bled off. Applicant prefers that the service tool 102 be axially reciprocated within the gravel pack packer 100 to check that all positions of the service tool in the packer may be accessed. Where the MPT service tool is used with the VTL gravel pack packer in the method 60, there are four axial positions of the service tool 102 relative to the packer 100.

The fracturing and/or gravel packing operations may then performed in a conventional manner, with proppant- and/or gravel-laden fluids being pumped down the interior of the tubing string 124 and outward through the ports 98 into the annulus 108, as indicated by arrows 134 in FIG. 4. Note that, in the description of the preferred embodiment of the method 60 thus far, no packer has had to be set, then unset, and then reset in the casing 68. With the gravel pack packer 100 set in the casing 68, the seal assemblies 86 inserted in the sump packer 66, and the screen 78 positioned opposite the perforated formation 62, as representatively illustrated in FIG. 4, the fracturing and/or gravel packing operations may be performed utilizing any of those techniques well known to those of ordinary skill in the art.

After the fracturing and/or gravel packing operations, the service tool 102 may be withdrawn from the gravel pack packer 100 by picking up on the tubing string 124 at the earth's surface. In some circumstances, expensive weighted fluids, such as Zinc Bromide (ZnBr) or other fluids, may be used as completion fluids to ensure control of the well after the fracturing and/or gravel packing operations. In that case, the completion fluids are generally circulated through the tubing string 124, work string 72, and annulus 130 prior to retrieving the tubing string, packer 104, and service tool 102 to the earth's surface.

In another unique feature of the method 60, the completion fluids may be recovered from the well after the tubing string 124, packer 104, and service tool 102 have been retrieved to the earth's surface, and before the formation 62 is produced. This feature of the method 60 has dramatic economic impact on the operations wherein the expensive ZnBr fluids are utilized for the completion fluids. FIG. 5 representatively illustrates that portion of the method 60 wherein the completion fluids are recovered from the well.

After the fracturing and/or gravel packing operations, an upper packer 136 is set in the wellbore 64 above the gravel pack packer 100. Applicant prefers that the upper packer 136 be conveyed into the wellbore 64 on wireline, but it may also be set on tubing, etc. Interconnected to the upper packer 136, and suspended therefrom, is a foot valve 138, which is well known to those of ordinary skill in the art. The foot valve 138, conversely to the flapper valve 94, permits fluid flow axially downward therethrough, but is capable of preventing fluid flow axially upward therethrough. The foot valve 138 is preferably normally closed.

As representatively illustrated in FIG. 5, the flapper valve 94 is open, but it is to be understood that, with the service tool 102 and washpipe 116 removed therefrom, the flapper 114 will close and prevent flow of the completion fluids axially downward through the flapper valve 94 and into the formation 62. Thus, the flapper valve 94 is utilized to prevent loss of the completion fluids.

The upper packer 136 includes an axially extending inner seal bore 140. After the upper packer 136 is set in the casing 68, a production seal assembly 142 is run into the wellbore 64 suspended from a tubing string 144 extending to the earth's surface. Applicant then prefers that the production seal assembly 142 be stabbed into the upper packer 136, so that seals 146 on the production seal assembly sealingly engage the seal bore 140.

At this point, the tubing string 144 may be spaced out and a tree (not shown) may be nippled up at the earth's surface. The tree and tubing string 144 may then be raised at the earth's surface until the seals 146 come out of the seal bore 140, establishing fluid communication between the interior of the tubing string 144 and an annulus 148 extending to the earth's surface. The completion fluids may now be circulated (displaced) out of the wellbore 64 by, for example, pumping a lighter fluid through the interior of the tubing string 144 from the earth's surface, through the production seal assembly 142, and upward through the annulus 148 to the earth's surface.

When the completion fluids have been displaced out of the wellbore 64 above the upper packer 136, the tubing string 144 is lowered to sealingly engage the seals 146 with the seal bore 140. The foot valve 138 opens when a production tube 150 attached to the production seal assembly 142 is inserted axially therethrough. FIG. 5 shows the foot valve 138 open, with the seal assembly 142 inserted into the upper packer 136.

Although it will be readily apparent to one of ordinary skill in the art that, with the lighter fluid in the tubing string 144 and the seals 146 sealingly engaging the seal bore 140, the flapper valve 94 will be opened by a pressure differential acting from below the flapper 114, tests performed by the applicant have indicated that fluid is compressed above the flapper when the seals 146 enter the seal bore 140. For this reason, applicant prefers use of a frangible flapper 114, so that when fluid is compressed above the flapper due to insertion of the seals 146 in the seal bore 140, the flapper is permitted to break, thereby providing immediate fluid communication between the annulus 108 and the interior of the tubing string 144, permitting production of fluids from the perforated formation 62.

As described hereinabove, some of the elements of the work strings utilized in the apparatus and associated methods embodying principles of the present invention are preferably manufactured by, and available from, Halliburton Company of Duncan, Okla. These elements and others, and some of the perforating, fracturing, and/or gravel packing operations, etc. described hereinabove are well known to those of ordinary skill in the art, and may be more fully described in a Halliburton Energy Services publication no. F3351 entitled FRACPAC COMPLETION SERVICES, 2d ed., Otis Engineering Corp. publication no. 5601-1 entitled INNOVATION, Otis Engineering Corp. publication no. 5545 entitled MULTI-POSITION GRAVEL PACK SYSTEM, and Halliburton Energy Services publication no. CPP5653 entitled COMPLETION PRODUCTS, each of which are hereby incorporated herein by reference.

The foregoing detailed description is to be clearly understood as being given by way of illustration and example only, the spirit and scope of the present invention being limited solely by the appended claims.

What is claimed is:

1. A method of producing fluid from a formation intersected by a subterranean well, the well having a generally axially extending bore, the method comprising the steps of:

operatively positioning a first packer within the wellbore, the first packer having a generally axially extending seal bore formed therethrough, the first packer being positioned relative to the formation, such that the formation is axially between the first packer and the earth's surface;

suspending a work string within the wellbore, the work string including a generally axially extending seal assembly, a generally tubular screen assembly, and a second packer, the screen assembly being interconnected axially between the seal assembly and the second packer;

perforating the formation utilizing a perforating device;

sealingly engaging the seal assembly with the seal bore by inserting the seal assembly axially into the first packer; and setting the second packer.

2. The method according to claim 1, wherein the step of suspending the work string further comprises providing the perforating device as a perforating gun, connecting the perforating gun within the work string, and positioning the perforating gun axially relative to the seal assembly.

3. The method according to claim 2, wherein the step of positioning the perforating gun further comprises interconnecting the seal assembly axially between the screen assembly and the perforating gun.

4. The method according to claim 2, wherein the step of perforating the formation further comprises positioning the screen assembly relative to the formation a first preselected distance in a first axial direction and positioning the seal assembly relative to the first packer the first preselected distance in the first axial direction.

5. The method according to claim 4, wherein the step of positioning the perforating gun further comprises positioning the perforating gun opposite the formation and positioning the perforating gun relative to the seal assembly such that when the seal assembly is axially displaced from the first preselected distance relative to the first packer to sealing engagement with the seal bore in a second axial direction opposite to the first axial direction, the perforating gun is thereby displaced in the second axial direction through the seal bore.

6. The method according to claim 1, wherein the step of sealingly engaging the seal assembly with the seal bore further comprises positioning the screen assembly axially relative to the seal assembly, such that when the seal assembly is inserted through the first packer, the screen assembly is thereby positioned opposite the formation.

7. The method according to claim 1, further comprising the steps of:

providing a third packer;

interconnecting the third packer into the work string;

unsetting the second packer; and setting the third packer.

8. The method according to claim 7, wherein the step of setting the third packer is performed after the step of unsetting the second packer.

9. The method according to claim 7, wherein the step of sealingly engaging the seal assembly is performed after the step of unsetting the second packer and before the step of setting the third packer.

10. The method according to claim 7, further comprising the steps of:

providing a packer service tool configured for operative engagement with the third packer; and interconnecting the packer service tool into the work string axially between the second and third packers, the packer service tool being operatively engaged with the third packer.

11. The method according to claim 10, further comprising the steps of:

disengaging the packer service tool from the third packer; and withdrawing the packer service tool and the second packer from the wellbore.

12. The method according to claim 10, wherein the step of setting the third packer comprises transporting a ball through the work string to the packer service tool and applying pressure to the work string.

13. The method according to claim 12, wherein the step of applying pressure to the work string comprises applying a first predetermined pressure to the work string to set the packer, and applying a second predetermined pressure to the work string to thereby axially displace the ball within the packer service tool.

14. The method according to claim 10, wherein the step of setting the third packer further comprises applying pressure to the work string, and further comprising the step of disengaging the packer service tool from the third packer during performance of the step of applying pressure to the work string.

15. A method of producing fluids from a formation intersected by a subterranean well, the method comprising the steps of:

providing first, second, and third packers, the first packer being mechanically settable, the second packer being hydraulically settable, and the third packer having a seal bore formed axially therethrough;

providing a generally tubular screen and a generally axially extending seal assembly, the seal assembly being capable of axial insertion into the seal bore and sealing engagement therewith;

assembling a work string by interconnecting the first and second packers, the screen, and the seal assembly;

setting the third packer within the well; and positioning the work string at a first position within the well so that the seal assembly sealingly engages the seal bore.

16. The method according to claim 15, wherein the step of assembling the work string further comprises interconnecting the second packer axially between the first packer and the screen, and interconnecting the screen axially between the second packer and the seal assembly.

17. The method according to claim 15, further comprising the steps of:

positioning the work string at a second position within the well so that the seal assembly is axially separated from the seal bore; and setting the first packer within the well.

18. The method according to claim 17, wherein the work string is positioned at the second position after the third packer is set in the well, and before the first packer is set in the well.

19. The method according to claim 17, wherein the step of setting the third packer comprises positioning the third packer so that the formation is axially between the third packer and the earth's surface, and wherein the step of positioning the work string at the second position further comprises positioning the seal assembly so that the formation is axially between the seal assembly and the third packer.

20. The method according to claim 19, further comprising the step of perforating the formation after the step of positioning the work string at the second position and before the step of positioning the work string at the first position.

21. The method according to claim 15, further comprising the step of interconnecting a perforating gun to the work string, and wherein the step of positioning the work string at the first position further comprises inserting the perforating gun axially through the third packer.

22. The method according to claim 15, further comprising the steps of:

setting the first packer within the well by manipulation of the work string from the earth's surface;

unsetting the first packer before the step of positioning the work string at the first position; and setting the second packer within the well by applying fluid pressure to the work string after the step of positioning the work string at the first position.

23. The method according to claim 15, wherein the step of positioning the work string at the first position further comprises positioning the screen opposite the formation.

24. A method of producing fluids from a formation intersected by a subterranean well, the method comprising the steps of:

providing first, second, and third packers, the third packer having a seal bore formed axially therethrough;

providing a generally tubular screen and a generally axially extending seal assembly, the seal assembly being capable of axial insertion into the seal bore and sealing engagement therewith;

providing a flapper valve;

assembling a work string by interconnecting the first and second packers, the screen, the seal assembly, and the flapper valve;

setting the third packer within the well; and positioning the work string at a first position within the well so that the seal assembly sealingly engages the seal bore.

25. The method according to claim 24, wherein the step of assembling the work string further comprises interconnecting the flapper valve axially between the second packer and the screen.

26. The method according to claim 24, further comprising the steps of:

positioning the work string at a second position within the wellbore;

setting the first packer;

perforating the formation utilizing a perforating device;

unsetting the first packer; and setting the second packer.

27. The method according to claim 26, wherein a first hydrostatic pressure exists at the intersection of the well and the formation, and further comprising the steps of:

flowing stimulation fluids through the work string and into the formation after the steps of perforating the formation and setting the second packer; and flowing completion fluids into the well, the completion fluids having a second hydrostatic pressure greater than the first hydrostatic pressure.

28. The method according to claim 27, further comprising the step of closing the flapper valve to thereby prevent flowing of at least a portion of the completion fluids into the formation.

29. The method according to claim 28, further comprising the steps of:

providing a fourth packer;

providing a foot valve;

interconnecting the fourth packer to the foot valve;

positioning the fourth packer and foot valve within the well so that the foot valve is axially between the fourth packer and the second packer; and setting the fourth packer.

30. The method according to claim 29, further comprising the steps of:

withdrawing the first packer from the well before the step of positioning the fourth packer and foot valve within the well;

attaching a production seal assembly to a tubing string; and disposing the production seal assembly and tubing string within the well.

31. The method according to claim 30, further comprising the steps of:

circulating the completion fluids from within the well; and positioning the production seal assembly within an internal bore of the fourth packer to thereby open the foot valve and sealingly engage the production seal assembly with the internal bore.

32. The method according to claim 31, wherein the step of positioning the production seal assembly within the internal bore further comprises opening the flapper valve to thereby permit flow of formation fluids from the formation through the tubing string to the earth's surface.

33. The method according to claim 32, wherein the step of providing the flapper valve comprises providing a frangible sealing element within the flapper valve, and wherein the step of opening the flapper valve further comprises breaking the frangible sealing element.

34. Apparatus for producing fluids from a formation intersected by a subterranean well, the apparatus comprising:

a first packer;

a second packer operatively interconnected to the first packer;

a generally tubular screen operatively interconnected to the second packer; and a generally axially extending seal assembly operatively interconnected to the screen.

35. The apparatus according to claim 34, further comprising a perforating gun operatively interconnected to the seal assembly.

36. The apparatus according to claim 34, further comprising a valve operatively interconnected axially between the second packer and the screen.

37. The apparatus according to claim 34, wherein the first packer is mechanically settable, and wherein the second packer is hydraulically settable.

38. The apparatus according to claim 34, further comprising a packer service tool operatively interconnected axially between the first and second packers, the packer service tool being capable of disengaging from the second packer to thereby permit withdrawal of the first packer and the packer service tool from the well after the second packer has been set in the well.

39. The apparatus according to claim 34 further comprising a third packer, the third packer having an axially extending bore, and the third packer being settable within the well such that the seal assembly is positionable within the bore for sealing engagement therewith.

40. The apparatus according to claim 34, further comprising a valve operatively interconnected axially between the second packer and the screen.

* * * * *